US005454699A

United States Patent [19]

Heng

[11] Patent Number: 5,454,699

[45] Date of Patent: Oct. 3, 1995

[54] WOBBLE PUMP

[75] Inventor: Thomas Heng, Worms, Germany

[73] Assignee: KSB Aktiengesellschaft, Frankenthal, Germany

[21] Appl. No.: 211,346

[22] PCT Filed: Sep. 8, 1992

[86] PCT No.: PCT/EP92/02076

§ 371 Date: Mar. 23, 1994

§ 102(e) Date: Mar. 23, 1994

[87] PCT Pub. No.: WO93/06371

PCT Pub. Date: Apr. 1, 1993

[30] Foreign Application Priority Data

Sep. 23, 1991 [DE] Germany ..... 41 31 628.2

[51] Int. Cl.[6] ..... F01C 1/02

[52] U.S. Cl. ..... 418/53; 418/139; 277/212 R

[58] Field of Search ..... 418/52, 53, 139, 418/153; 277/212 R, 212 C, 212 FB

[56] References Cited

U.S. PATENT DOCUMENTS

| | | | |
|---|---|---|---|
| 2,329,604 | 8/1943 | Ginter | 418/53 |
| 5,125,809 | 6/1992 | Hartley et al. | 418/153 |

FOREIGN PATENT DOCUMENTS

| | | | |
|---|---|---|---|
| 1090966 | 10/1954 | Germany . | |
| 1277673 | 11/1965 | Germany . | |
| 2617516 | 11/1977 | Germany | 418/53 |
| 3729726A1 | 9/1987 | Germany . | |
| 3831068A1 | 9/1988 | Germany . | |
| 39054419A1 | 2/1989 | Germany . | |
| 861332 | 3/1959 | United Kingdom . | |
| 1143675 | 5/1966 | United Kingdom . | |

OTHER PUBLICATIONS

Neumayer, R., Reinigbare Pumpen, CAV, Mar. 1989, pp. 125, 127.

Krämer, R., Gefährliche Medien sicher fördern, CAV, Feb. 1989, pp. 100, 102, 104–106 JP 1–208 584 A.

*Primary Examiner*—Richard A. Bertsch
*Assistant Examiner*—Charles G. Freay
*Attorney, Agent, or Firm*—Darby & Darby

[57] ABSTRACT

A swash plate pump having a pump housing comprises a swash plate shaft and a swash plate being disposed in a pump chamber. The pump chamber has an intake and a delivery opening. The pump chamber is formed by two lateral surfaces and by a spherical inner surface and a spherical outer surface. The swash plate performs a wobbling motion. The swash plate is provided with a circular ring that is mounted on the spherical inner surface. A partition, which divides the circular ring of the swash plate, is disposed in the housing with at least one first lateral space disposed on a side that is remote from a drive of the swash plate and a second lateral space disposed on a side that is adjacent to the drive of the swash plate. The shaft passes through a plurality of dynamic seals in the housing. The section of the shaft, disposed within the housing, is in fluid communication with the pump chamber by the medium to be pumped. A first elastic static seal is provided for shutting off the space acted upon by the medium to be pumped. The lateral spaces, supplied with the medium to be pumped, are in fluid communication with the intake and delivery part of the pump and have the flow moving through them, in the direction of the medium to be pumped.

9 Claims, 1 Drawing Sheet

WOBBLE PUMP

BACKGROUND OF THE INVENTION

1. Field of the Invention

The present invention relates to a wobble pump on which the invention is based operates on the following principle. When a drive shaft is turning a swash plate shaft is moved so as to describe a double cone about the center axis of the drive shaft. Owing to the oblique setting of the swash plate pump shaft in relation to center axis of the shaft a swash plate which is perpendicular to the swash plate shaft in a pump chamber accommodating it will perform a wobbling movement about a wobble point on the center axis of the drive shaft. A partition extending in the axial direction of the drive shaft and intersecting the swash plate divides the pump chamber into an intake part and a delivery part. Owing to the moving swash plate two circularly extending, variable-volume pumping spaces are produced within the pump chamber.

2. Discussion of the Related Art

A swash plate pump in which the swash plate is arranged in the pump chamber, whose housing surfaces opposite to the swash plate are spherical in form is disclosed in DE-B 1,090,966. The plane of the pump chamber extends perpendicularly to the plane of the drive shaft. Owing to the swash plate, which is arranged obliquely in the pump chamber, the pumping chambers are formed on either side of the swash plate which are variable in volume. The swash plate which is moving in the pump chamber is designed in the form of a circular ring, which is so arranged that its internal diameter lies on a spherical surface of a hub of the swash plate. This spherical surface is supported by a bearing in correspondingly formed mating surfaces of the pump housing which encloses the pump chamber. Since between such bearing surfaces medium is able to emerge from the pump chamber and to flow into the space comprising the swash plate shaft and then escape to the outsider an elastic boot seal is provided between the hub of the swash plate and the swash plate shaft bearing. At the one end such boot is connected with the stationary pump housing and at the other end of this boot is attached to a sleeve drawn onto the swash plate shaft and it is statically sealed at either end.

Although in the case of known swash plate pumps there is a hermetic termination of the space acted upon by the medium to be pumped so that the space is sealed off from the surroundings, this design means that there is a space with a low degree of liquid exchange between the pump chamber and the space comprising the swash plate shaft. This space consequently acts as a dead space, in which the medium collects and in which it remains substantially without any change. This design of pump is unsuitable for products which are likely to be damaged, as for instance foodstuffs or the like materials which have to be handled under highly hygienic conditions. The dead space means that each time the pump is stopped its housing has to be opened and thoroughly cleaned. Otherwise the medium present in the dead space would decompose, microbes or the like would find their way into the housing and would have a deleterious effect on the pumped medium.

SUMMARY OF THE INVENTION

The present invention provides a swash plate pump with an extremely powerful self-cleaning effect and is suitable for pumping media which are affected and more particularly impaired if the timing of the pumping operation is not correct, such media being more particularly foodstuffs or biological solutions.

The advantages able to be obtained with the invention render possible the use of the pump in biotechnology, foodstuffs technology or for pumping media likely to be degraded. Owing to the lateral spaces through which the medium flows, the pump is able to be sterilized in the assembled condition. In accordance with the present invention, the entire space, in which the medium to be pumped is able to enter from the pump chamber, more particularly the lateral spaces, is included by means of pipes, ducts or equivalent means in the duct system of the pump or of the medium and has the medium continuously or controlledly flowing through it. Therefore, the residence time of a particle of the medium may be controlled, and deposits, such as crystals from the medium, may be prevented or at least substantially reduced. Complete cleaning of all components coming into contact with the medium is rendered possible without taking the pump to pieces. For cleaning it is sufficient to run a swilling liquid through the pump in order thus to clear all product residues from the housing.

Further developments of the present invention relate to various possible orders of flow through the pump chamber and the lateral spaces. The lateral spaces have, for this purpose, at least one respective connection for the inlet and outlet of the medium. Dependent on the particular type of medium, its properties and on the process conditions it is possible to select the respectively suitable order of flow through the chambers. Therefore, in the simplest possible fashion, the formation of deposits may be prevented in a sort of continuous cleaning operation. In this respect it is unimportant whether in the course of operation the full flow or merely a part thereof passes through the lateral space. Dependent on the medium, it is even possible to interrupt flow through the lateral spaces for some time in the normal operating state.

The design of the present invention simplifies the production of the pump substantially and renders the sealing properties of the pump more effective and consequently its efficiency is improved. The pump chamber is delimited by two side parts, that is to say an intermediately arranged ring with a conically shaped inner surface and the spherical, present on the minor diameter, of the swash plate. The spherical inner surface of the ring constitutes, together with circular ring of the swash plate, the dynamic seal for separating the pumping chambers from one another. Owing to division into four parts of the pump chamber walls only one component is provided with a spherical inner surface to provide an external sealing means for the external diameter of the swash plate. The joint between the components of the pump chamber does not extend in the spherical surface and instead of this two joints are arranged on the lateral surfaces. Here sealing devices suitable for the particular application are to be fitted. The spherical inner surface is a sealing surface for sealing off the pumping chambers and the external diameter of the swash plate sweeps over this surface. Owing to the placement of the joint at the lateral surface an optimum matching between the outer configuration is ensured in order to obtain a satisfactory sealing effect. This design of the pump chamber with separate lateral surfaces and the ring is rendered possible by a recess in the ring. The swash plate is concentrically placed over the recess while arranged vertically, into the ring and by pivoting is moved into the operational setting. After this a partition is anchored at the position of the recess and a sealing action produced between it and the ring. The minimum width of the recess is determined by the width of the swash plate.

A further development comprises the teaching of using a partition, in the case of which for a seal between it and the lateral walls elastic sealing elements are provided between the partition and the lateral walls. This seal can be in the form of an in situ vulcanized layer on the partition, but however it is also possible to employ stand alone seal elements. The partition is applied in the ring after the fitting of the swash plate at the position of the recess. It possesses a spherical surface with the same radius as the spherical surface bearing the swash plate and is seated on the latter while maintaining the sealing gap. For assembly purposes, the partition is so dimensioned that between it and the ring there is still an intermediate space. In the latter an elastic seal is inserted in order to provide a sealing action between the partition and the ring. This elastic seal exerts a loading thrust on the intermediate member and causes there to be a gap-free static sealing effect at the lateral walls.

Further development provides for a dual static sealing action sealing off the pump chamber from the atmosphere. This increases the field of application of the pump as regards use with aggressive or toxic media. If the second static seal acted upon by the medium should rail, the first static seal will act as an additional safeguard.

A further development provides for enhanced mobility of the second static seal owing to the use of an elastic diaphragm. In addition to this, the space enclosed between the first and the second static seals can be charged with a liquid. Since liquids are to be regarded as incompressible and the volume of the space divided by the diaphragm remains constant, no pressure differential will build up at the diaphragm. Instead there will be the same pressure on either side and the diaphragm will merely be subject to the wobble motion.

This leads to the advantage that owing to the monitoring of certain properties of a monitoring liquid arranged in the space between the first and the second static seal operational reliability is increased. A change in one of the properties being monitored by entry of pumped medium into the monitoring liquid may be detected at once by sensors. Therefore, there is the possibility of early recognition of damage without the pumped medium leaking from the equipment.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE INVENTION

Figure 1:
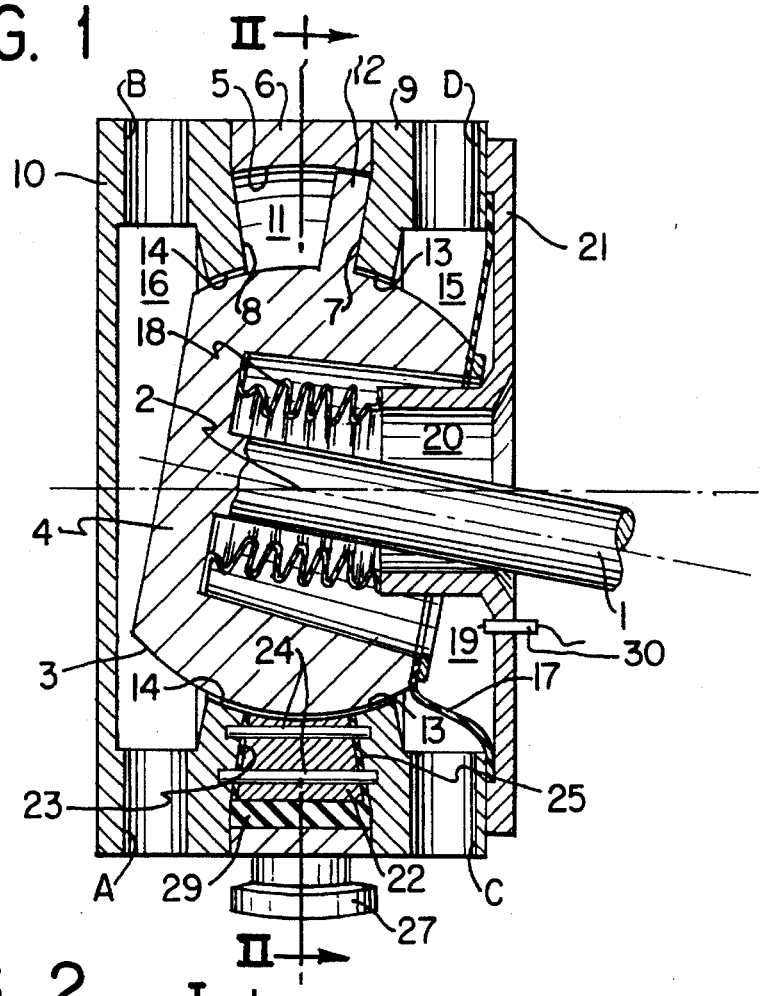
FIG. 1 shows a swash plate pump in a longitudinal section taken on the line I—I of FIG. 2.

In FIG. 1 a swash plate pump is illustrated. A swash plate shaft 1 is moved about a wobble point 2 by a drive (not illustrated) so as to describe a double conical surface. The wobble point 2 coincides with the center point of the spherical surface 3 of the swash plate 4 and the spherical inner surface 5 of a ring 6. These surfaces together with conical lateral surfaces 7 and 8 of a first lateral part 9 connected with the drive and having a center opening, and of a second lateral part 10, delimit a pump chamber 11. In the pump chamber 11 there is a circular ring 12, which is seated on the spherical surface 3 of the swash plate 4 and which is moved by means of the swash plate shaft 1 in the pump chamber 11. The center opening in the first drive-side lateral part 9 serves to lead through the swash plate shaft 1.

The swash plate shaft 1 can be connected with the swash plate 4 in various different manners, for instance by welding, screwing and the like. The swash plate 4 may be manufactured in one piece in order to obtain maximum accuracy. However, it is naturally possible for the swash plate to be made in a plurality of parts as a compound structure. The outer edge of the circular ring 12 of the swash plate 4 is preferably designed with a configuration corresponding to spherical inner surface 5 in order to produce a dynamic sealing action. The pump chamber 11 is sealed off from the inner space of the pump by dynamic seal means between the spherical surface 3 and the corresponding spherical surfaces 13 and 14 of the lateral parts 9 and 10. Simultaneously, it is possible for the swash plate 4 also to be supported by bearings at these positions. The lateral spaces 15 and 16 of the pump are reached by the medium pumped through the gap of the dynamic seal on the spherical surfaces 3, 13 and 14.

On the drive side, the lateral space 15, which is reached by the medium, is shut off by a diaphragm 17. The diaphragm 17 is attached to the spherical surface 3 and to the lateral part 9 and statically sealed off here respectively. The diaphragm 17 does not have to be designed to withstand the pressure differential with respect to the atmosphere. The pressure differential is in this embodiment of the invention withstood by a further sealing element, for instance in the form of a boot 18 as illustrated. Between the boot 18 and the diaphragm 17 there is a space 19, through which there is no flow. This space is able to be charged with a monitoring fluid or medium. The diaphragm 17 is elastic and deformable, the same hydrostatic head will become established in the space 19 as in the lateral space 15 and the diaphragm 17 will merely undergo a deformation.

The boot 18 takes up the pressure differential and complies with the wobbling motion of the swash plate 4 with an elastic deformation of the folds therein. Boot 18 seals off the space 519 statically from the atmosphere and with respect to the bearing space 20 of the swash plate shaft 1. For this purpose the boot 18 is applied at one end to the wobbling member and at the other end is connected with a stationary housing part, here for example in the form of a cover 21 with a center opening for the passage of the swash plate shaft 1. In addition to this, the boot 18 prevents twisting of the shaft 4 about the center axis of the boot 18. This means for preventing rotation may however be in some other conventional form. The cover 21 also seals off the diaphragm 17 in this embodiment of the invention and is joined with the lateral part 9.

The lateral part 9 is provided with connections C and D, owing to which the lateral space 15 may be completely included in the medium flow. For flow through the lateral space 16 there are ports A and B on the lateral part 10. Owing to such ports it is possible for the lateral spaces 15 and 16 to be included in the duct system of the swash plate pump and for the advantages in accordance with the present invention to be obtained. The order of flow through the lateral spaces 15 and 16 and the pump chamber 11 may be selected in accordance with the respective conditions of application. Thus, it is possible for flow through the lateral spaces 15 and 16 to take place prior to entry of the medium into the pump chamber 11 or after emergence thereof from the pump chamber 11. Furthermore, flow through one lateral space prior to passage of the medium into the pump chamber 11 and flow through the other lateral space after emergence from the pump chamber 11 is possible. Furthermore, it is possible to provide devices by which not the complete flow but merely a part thereof is branched into the lateral spaces. It is furthermore possible not to have a full flow through the lateral spaces but only a flow at certain times. The setting of the flow is dependent on the medium being pumped and on its state conditions. Furthermore, the position of the ports A through D on the housing has an effect on the flow through the lateral spaces. In this case, besides the intake and outlet opening A through D as illustrated being disposed opposite to one another, further arrangements could be possible.

The housing of the swash plate pump is held together with known means. One feature of the swash plate pump is the separation of the intake and delivery sides of the pump chamber 11 by a partition 22 arranged transversely in relation to the pump chamber 11.

The circular ring 12 of the swash plate 4 possesses for this purpose a recess with at least the wall thickness of the partition 22. Since the wobble movement of the swash plate 4 in the pump chamber 11 is made up of two combined rotary movement components about the two axes which together with the center axis of the pump chamber 11 define a rectangular, three dimensional coordinate system, the surfaces, which face the partition, of the recess perform a relative movement with respect to the stationary partition 22. Accordingly the minimum width of the recess is dependent on the form of its surfaces. The surfaces of the recess do not have to enter into a sealing function with the partition 22. It is furthermore possible to allow a larger amount of play between the surfaces of the recess and the partition 22. The partition 22 is mounted with play on the spherical surface 3, is provided with a corresponding sealing surface 23 and is anchored by, for example, locating pins 24 in the lateral parts 9 and 10. An elastic coating 25 on the lateral flanks of the partition 22 provides the static seal, since it engages the lateral surfaces 7 and 8. However, other forms of static seal are conceivable.

The lateral spaces 15 and 16 and furthermore the space 19 and also the bearing space 20 can be provided with a monitoring device 30. This renders possible prompt recognition of any leak in a seal. More particularly the space 19 can be charged with a monitoring medium in which changes can be detected with sensors. It is preferred to use a monitoring medium which is compatible with the pumped medium.

The cleaning operation is performed by the introduction of a swilling liquid into the lateral spaces 15 and 16 and into the pump chamber 11. The cleaning liquid will come into contact with all surfaces and spaces swept by the pumped medium. During the pumping operation of the swash plate pump there is a continuous self-cleaning effect owing to flow through the lateral spaces 15 and 16, thus limiting the residence time of a particle of the pumped medium. Thus, the pumping of unstable materials which may change with time is rendered possible by the present invention.

Figure 2:
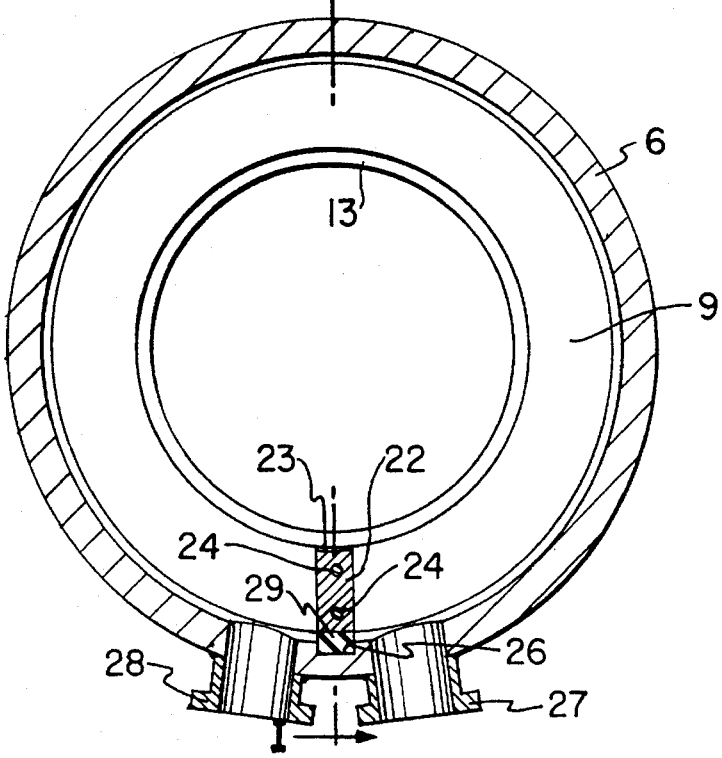
FIG. 2 is a cross section of part of the pump taken on the line II–IL of FIG. 1.

From FIG. 2, a section taken on the line II—II in FIG. 1, showing part of the structure it is possible to recognize that the ring 6 arranged between the lateral parts 9 and 10 possesses a recess, for example in the form of a groove 26, which is necessary for the swash plate 4 for reasons of assembly. This groove 26 is located between the intake and delivery openings 27 and 28 of the pump and is in alignment with the partition 22. The recess 26 in the ring has a breadth which is at least equal to the breadth of the circular ring 12 of the swash plate 4. After assembly of the swash plate 4 is completed, the partition 22 is inserted, and the groove 26 is closed by a seal 29, which seals off the partition 22 from the housing by a static sealing effect. The seal 29 is slightly wider than the ring 6. It is so squeezed together in the course of assembly of the lateral parts 9 and 10 by the same that owing to its incompressibility it is merely able be displaced towards the partition 22 and consequently provides a thrust towards the wobble point 2. This force is also responsible for pressing the partition 22 against the lateral surfaces 7 and 8, the partition 2, or parts thereof, being able to undergo elastic deformation and cause a static sealing effect.

In order to render possible use in foodstuffs technology all static seals between a plurality of parts are to be designed in accordance with the design configurations known therefor.

Having described the presently preferred exemplary embodiment of a new and improved wobble pump, in accordance with the present invention, it is believed that other modifications, variations and changes will be suggested to those skilled in the art in view of the teachings set forth herein. It is, therefore, to be understood that all such variations, modifications, and changes are believed to fall within the scope of the present invention as defined by the appended claims.

What is claimed is:

1. A swash plate pump for pumping a medium having a pump housing, comprising:

a swash plate shaft; a swash plate being disposed in a pump chamber, said pump chamber having an intake and a delivery opening, said pump chamber being formed by two lateral surfaces and by a spherical surface of the swash plate and a spherical inner surface, said swash plate performing a wobbling motion, said swash plate being provided with a circular ring that is mounted on said spherical surface;

a partition dividing the circular ring of the swash plate, being disposed in the housing with at least one first lateral space spaced from said pump chamber and disposed on a side that is remote from a drive of the swash plate, said first lateral space being fluidly connected to said pump chamber by a dynamic seal, a second lateral space spaced from said pump chamber and disposed on a side that is adjacent to the drive of the swash plate, said shaft passing through a plurality of dynamic seals in said housing, said section of said shaft disposed within said housing being in fluid communication with the pump chamber by the medium to be pumped, a first elastic static seal being provided for shutting off a space acted upon by the medium to be pumped, wherein said lateral spaces being supplied with the medium to be pumped are in fluid communication with the intake and delivery openings of the pump and have the flow moving through them, in the direction of the medium to be pumped.

2. The swash plate pump as claimed in claim 1, wherein the medium to be pumped flows through one of said lateral spaces prior to entering the pump chamber and through the other of said lateral spaces after leaving the pump chamber.

3. The swash plate pump as claimed in claim 1, wherein the medium to be pumped flows through the first and second lateral spaces prior to entry into the pump chamber.

4. The swash plate pump as claimed in claim 1, wherein the medium to be pumped flows through the first and second lateral spaces after leaving the pump chamber.

5. The swash plate pump as claimed in claim 1, wherein the lateral surfaces rest against an intermediately arranged ring at said spherical inner surface, said inner spherical surface being disposed between intake and delivery openings, the ring has a recess with a breadth which is at least equal to the breadth of the circular ring of the swash plate.

6. The swash plate pump as claimed in claim 5, wherein on the side facing the spherical surface of the swash plate, the partition has a corresponding spherical surface, said partition being connected with the lateral surfaces of the pump chamber and being statically sealed by an elastic sealing element with respect to the lateral surface and an elastic sealing element with respect to the ring.

7. The swash plate pump as claimed in, claim 1, wherein the first elastic static seal is preceded by a second elastic static seal, and the second lateral space being acted upon by the medium to be pumped is arranged between one of said plurality of dynamic seals disposed adjacent to the spherical surface and said second elastic static seal.

8. The swash plate pump as claimed in claim 7, wherein said second static seal is an elastic diaphragm.

9. The swash plate pump as claimed in claim 7 wherein the space between said first and said second static seal is charged with a monitoring medium and is connected with a monitoring device.

* * * * *